US008783514B2

(12) United States Patent
Terhardt

(10) Patent No.: US 8,783,514 B2
(45) Date of Patent: Jul. 22, 2014

(54) DISPENSING GUN FOR A COLLAPSIBLE ADHESIVE-FILLED CONTAINER

(75) Inventor: Michael Terhardt, Audubon, PA (US)

(73) Assignee: Henkel US IP LLC, Rocky Hill, CT (US)

( * ) Notice: Subject to any disclaimer, the term of this patent is extended or adjusted under 35 U.S.C. 154(b) by 26 days.

(21) Appl. No.: 13/472,776

(22) Filed: May 16, 2012

(65) Prior Publication Data

US 2012/0292339 A1 Nov. 22, 2012

Related U.S. Application Data

(60) Provisional application No. 61/488,485, filed on May 20, 2011.

(51) Int. Cl.
*B65D 35/28* (2006.01)

(52) U.S. Cl.
USPC ..... 222/95; 222/105; 222/325; 222/326; 222/386.5

(58) Field of Classification Search
USPC ..... 222/94–95, 105, 325–327, 334, 386, 222/386.5, 389
See application file for complete search history.

(56) References Cited

U.S. PATENT DOCUMENTS

| | | | | |
|---|---|---|---|---|
| 3,712,516 | A * | 1/1973 | Stamets et al. | 222/326 |
| 3,813,012 | A * | 5/1974 | Laird | 222/326 |
| 4,113,151 | A * | 9/1978 | Brown et al. | 222/324 |
| 4,441,629 | A * | 4/1984 | Mackal | 222/324 |
| 4,840,293 | A * | 6/1989 | Segatz | 222/94 |
| 5,246,144 | A * | 9/1993 | Cathcart et al. | 222/153.13 |
| 5,535,925 | A * | 7/1996 | Hinden et al. | 222/327 |
| 7,445,135 | B2 * | 11/2008 | Miyata et al. | 222/326 |
| 8,011,538 | B2 * | 9/2011 | Herman et al. | 222/326 |
| 8,393,501 | B2 * | 3/2013 | Herman et al. | 222/326 |

* cited by examiner

*Primary Examiner* — Frederick C Nicolas
(74) *Attorney, Agent, or Firm* — James E. Piotrowski

(57) ABSTRACT

A portable gun provides for the dispensing of flowable adhesives. The gun accommodates a flowable adhesive contained in a collapsible container which adhesive is dispensed through an extending dispensing nozzle.

16 Claims, 6 Drawing Sheets

DISPENSING GUN FOR A COLLAPSIBLE ADHESIVE-FILLED CONTAINER

FIELD OF THE INVENTION

The present invention relates generally to a portable gun for dispensing flowable adhesive contained in a collapsible container. More particularly, the present invention relates to a pneumatically operated dispensing gun having an elongate barrel which accommodates an adhesive-filled collapsible tube for dispensing adhesive.

BACKGROUND OF THE INVENTION

Accurate application of various viscous materials such as adhesives and the like is typically achieved by the use of dispensing guns, most notably, caulking guns. A conventional caulking gun supports adhesive material in a tube or other container and is designed, by operation of the gun, to dispense or expel the adhesive through a nozzle at one end of the container. Many caulking guns of this type are manually operated in that repetitive actuation of a trigger moves a plunger-like piston into dispensing contact with the adhesive containing container. Continuous movement of the piston by hand operation provides for a continuous dispensing of the adhesive. Other guns of this type may be power driven, for example, by pneumatic operation. In these situations, air pressure is used to compress or collapse an adhesive containing tube to dispense the adhesive through the nozzle.

One specific use of such dispensing guns, by way of example, is to apply adhesives to floor joists where subflooring may be applied over the adhesively coated joists so as to fasten the subfloor to the joists. As may be appreciated, the gun must be capable of accurately dispensing the adhesive on the joist so that the proper amount of adhesive is applied with little waste. Many of the conventional dispensing guns, therefore, require the installer to operate the gun in close proximity to the floor joist. This would require the installer to have to kneel or bend to be close to the floor to accurately place the adhesive on the joists. Still further, the size of the guns requires frequent refilling which becomes time consuming and costly for installation.

SUMMARY OF THE INVENTION

The present invention provides a gun for dispensing a flowable adhesive contained in a collapsible tube which may be dispensed through an extending dispensing nozzle. The gun includes an elongate hollow barrel for accommodating the tube. The barrel has a closed first end and an open second end. The closed first end has an aperture therethrough for passage of the extending dispensing nozzle. A handle is attachable to the open end of the barrel for closing the open end. The handle has a connection port in communication with the hollow barrel for attachment to a source of pneumatic pressure. The handle further includes a trigger operably connected to a connection port to allow controlled flow of air pressure into the barrel which collapses the tube causing dispensing of the flowable adhesive therethrough.

The present invention provides an assembly which includes in combination an elongate adhesive dispensing gun, an elongate collapsible adhesive-containing tube having a dispensing nozzle at one end and guide attached to the nozzle.

In addition, a kit of parts is provided wherein the kit includes a plurality of different length barrels attachable to a handle at one end of the barrel. A cover encloses the other end of said barrel.

DETAILED DESCRIPTION OF THE PREFERRED EMBODIMENTS

The present invention provides a dispensing gun which pneumatically dispenses adhesive contained within a collapsible container such as an elongate collapsible tube having a tapered dispensing nozzle at one end. While the invention is described with respect to an elongate bag-like tube, other configurations are within the contemplation of the present invention.

Figure 1:
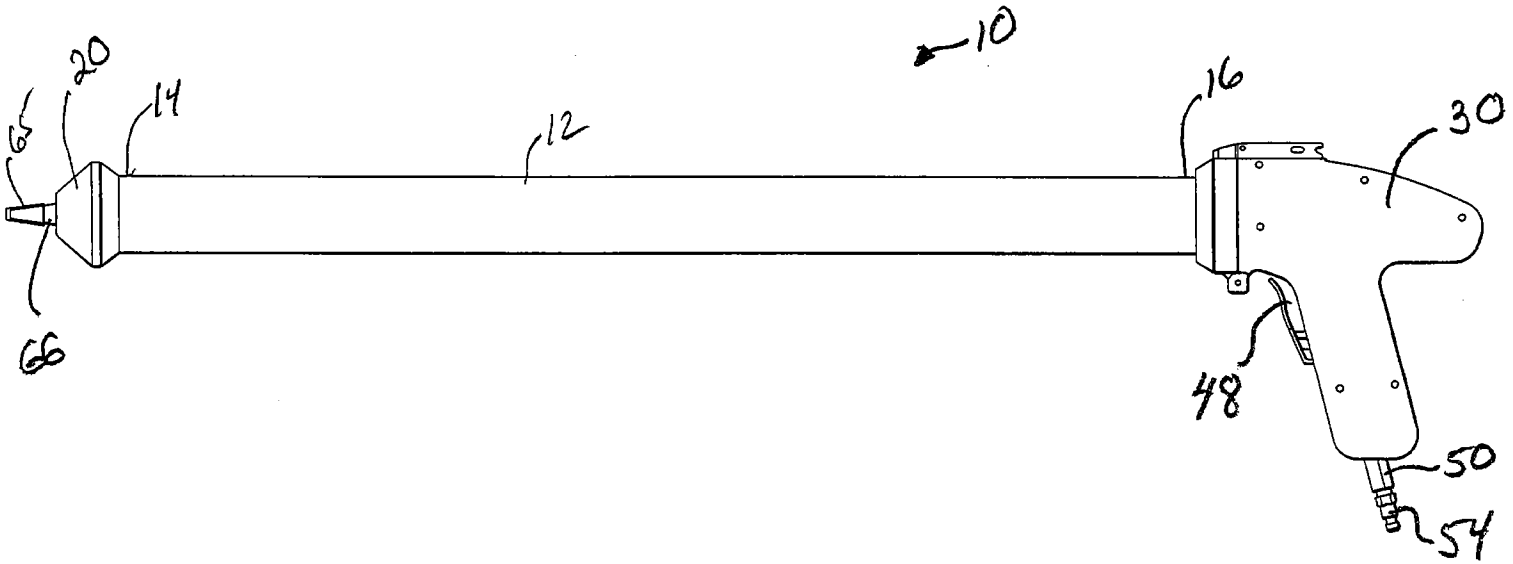
FIG. 1 is a plan view of a dispensing gun of the present invention.
Figure 2:
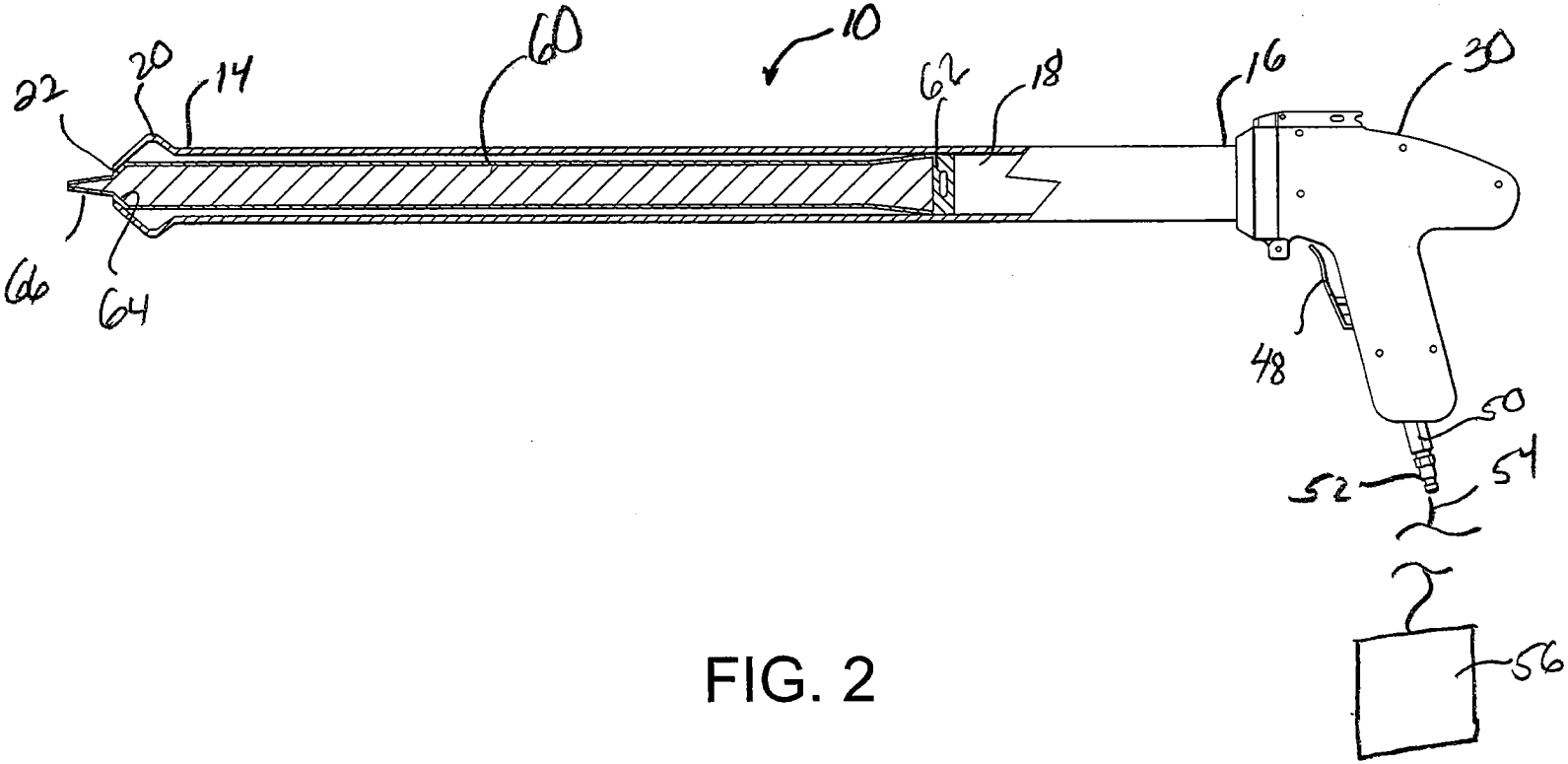
FIG. 2 is a plan view of the dispensing gun of FIG. 1, partially in section, showing the internal passage of the barrel.

Referring now to FIGS. 1 and 2, the dispensing gun 10 of the present invention is shown. Dispensing gun 10 includes an elongate hollow barrel 12 which is preferably cylindrical in configuration. The barrel includes a first open end 14 and an opposed second open end 16. The barrel further includes a generally hollow cylindrical passageway 18 extending between the ends 14 and 16.

Attached to the first end 14 of barrel 12 is a cover 20 which closes the first end. The cover may be affixed to the first end of barrel 14 by well known attachment methods such as press fitting the cover 20 onto the end 14. The cover is designed to attach to the first end of the barrel in a sealed air-tight fashion. Various sealed attachment techniques, including adhesive attachment, are within the contemplation of the present invention. As will be described in further detail hereinbelow, the cover 20 is configured to accommodate in sealed relationship the front end of a dispensing tube. In addition, the cover includes a central aperture 22 at a distal end thereof for accommodating the extending nozzle of the tube.

The second end 16 of barrel 12 supports thereon a handle 30. Handle 30 is generally in the configuration of a pistol grip. However, other configurations are within the contemplation of the present invention.

Figure 3:
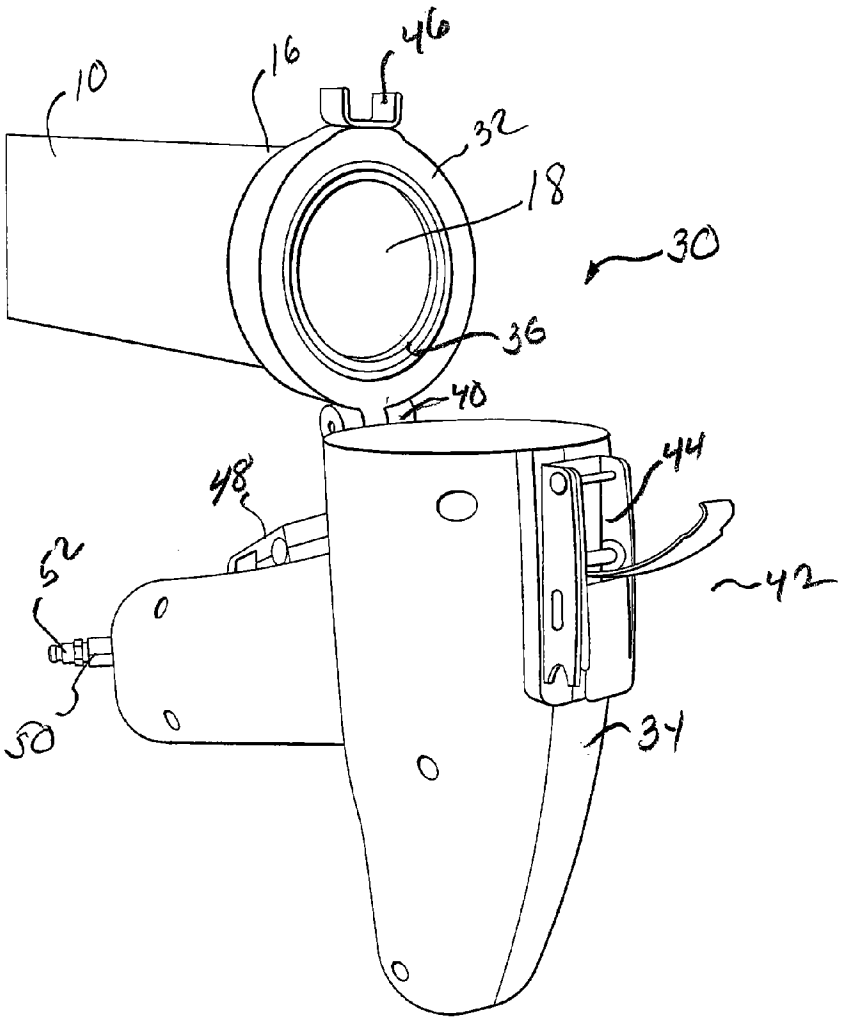
FIG. 3 is an enlarged perspective showing of a rear portion of the dispensing gun of FIG. 1 shown in the open condition.

Referring additionally to FIG. 3, the pistol grip handle 30 is a two component device including a cap portion 32 and a grip portion 34. The cap portion 30 is generally an annular member into which is fitted onto the second end 16 of barrel 12. As with the first end 14 of barrel 12, the second end 16 can be press fit or otherwise secured to the cap portion 32. The cap portion is designed to attach to the second end of the barrel in an air-tight fashion. An adhesive may be used to effect such sealing. The cap portion 32 includes an elastomeric sealing member 36 which preferably is in the form of an O-ring. The sealing member 36 provides for sealed engagement of the grip portion 34 of handle 30 with the cap portion 32. In that regard, the grip portion 34 is hingedly attached to cap portion 32 by a pivotal hinge 40. Hinge 40 permits movement of the grip portion 34 with respect to the cap 32 between an open condition shown in FIG. 3 and a closed condition shown in FIGS. 1 and 2. A releasable latch mechanism 42, including a latch 44 and a catch 46, provides for secure connection of the grip portion and the cap in the closed position.

Grip portion 34 further includes an operable trigger 48 which may be manually depressed by the user. The trigger is in operable connection with a pneumatic air connection port 50. Connection port 50 includes a mating connector 52 which can be used to snap fit to a pneumatic line 54 which extends to a source of pressurized air 56. The connection port 50 is in fluid communication with the grip portion 34 and cap portion 32 of handle 30 so as to establish fluid communication between the connection port and the interior 18 of barrel 12. The trigger may be depressed to open and close the fluid communication path between the connection port 50 and the interior 18 of barrel 12 to selectively apply pressurized air to the barrel passageway. The pressurized air source 56 may be any conventional pneumatic source and may be either fixed such as in the use of an air compressor which is attached with a pneumatic hose or may be portable to move along with the gun 10.

Turning again to FIGS. 1 and 2, an adhesive tube 60 is shown. Adhesive tube 60 is an elongate member having a closed rear end 62 and an opposite tapered forward end 64 having dispensing nozzle 66 extending therefrom. Dispensing nozzle 66 is a conventional tapered dispensing nozzle which permits the nozzle to be severed at various lengths therealong to increase the dispensing opening. A cap 65, shown in FIG. 1, may cover the cut tip of the dispensing nozzle when not in use. The tube 60 is generally a bag-like collapsible member which may be collapsed upon application of pneumatic pressure to dispense the adhesive contents contained therein through the dispensing nozzle 66.

Operation of the gun 10 of the present invention is shown with respect to FIG. 2. The collapsible adhesive tube 60 is loaded into the barrel 12 with the handle 30 being in the open position as shown in FIG. 3. The adhesive tube 60 is inserted into the passage 18 of the barrel until the nozzle extends through the opening in cover 20. The front end of the tube 60 seats with the cover 20 establishing an air-tight seal. The grip portion 34 is then pivotally closed to cap portion 32 and latchably secured employing latch 42. The gun 10 is connected to a source of compressed air 56 at connector 52. Trigger 48 is depressed permitting flow of pressurized air through connection port 50 and into passage 18 of barrel 12. Continuous pneumatic pressure applied to tube 60 results in collapsing of the tube and the dispensing of the adhesive contents through nozzle 66. Release of trigger 48 stops the flow of air through connection port 50 and thereby stops the dispensing of adhesive through nozzle 66. Thus, the present invention provides a pneumatically operated gun for dispensing adhesive from a collapsible tube. The amount of adhesive disposed can be controlled by controlling the air pressure as well as by the cutting of the nozzle.

Figure 4:
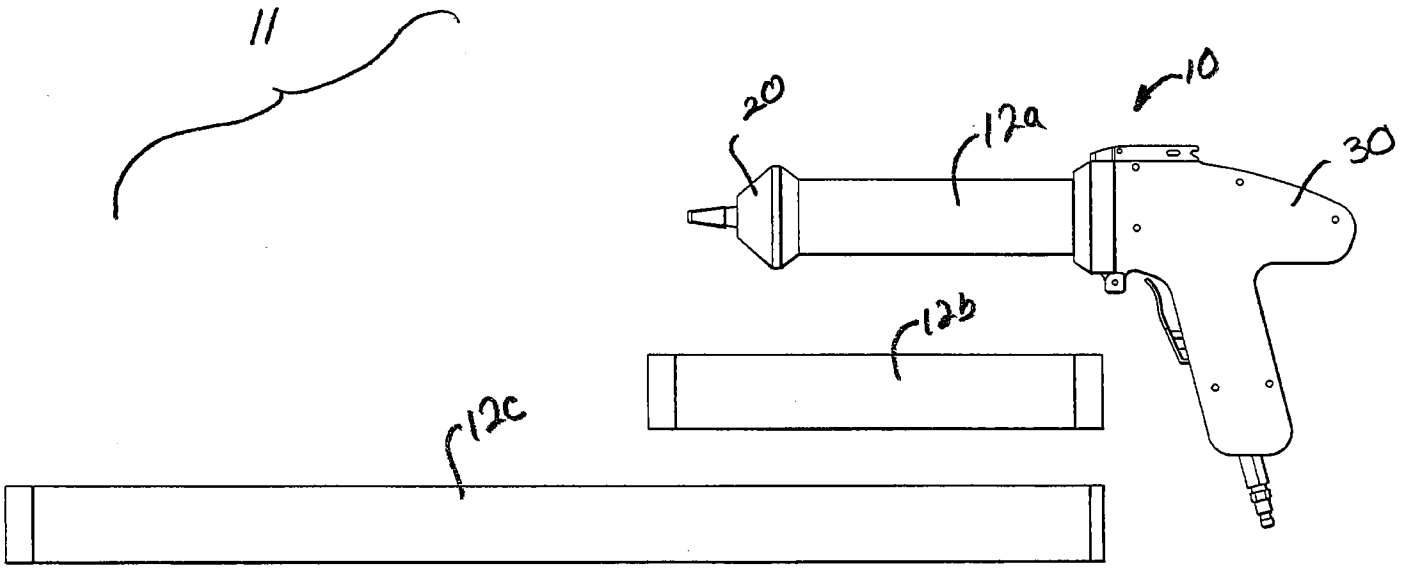
FIG. 4 shows the dispending gun of FIG. 1 and alternative length barrels used in combination therewith.

Referring now to FIG. 4, a further feature of the present invention is shown. As may be appreciated, the gun of the present invention may be used to dispense adhesive to various surfaces. Each of these surfaces may be at various distances from the installer who is applying the adhesive. For example, the installer may wish to apply adhesive to a relatively close surface, or in other situations, the surface to which the adhesive to be may be applied may be a distance from the installer. In these situations, the present invention provides a gun which allows for the selective attachment of different length barrels thereto.

As shown in FIG. 4, an assembly 11 may be provided where a plurality of different length barrels 12*a*, 12*b* and 12*c* may be employed. The installer would have the option to selectively use the desired length barrel by attaching the selected barrel to the handle 30 and cover 20. For example, where the installer wishes to apply adhesive to a surface in close proximity to the installer, a small length barrel 12*a* may be applied. In other situations, particularly in situations where the installer wishes to apply adhesive to floor joists for subsequent application of a subflooring, the installer may use the extended length barrel 12*c*. In such an instance, the installer may operate the adhesive gun to apply adhesive directly on the floor joists without having to kneel or bend to be close to the application location. While three barrel lengths are shown in FIG. 4, it is of course within the contemplation of the present application that the gun assembly may be provided with barrels of other numbers and lengths.

The ability to change or select barrel lengths also provides the ability to accommodate different sizes of adhesive tubes. Use of larger volume adhesive tubes would result in the need to less frequently reload the gun with another tube.

Figure 5:
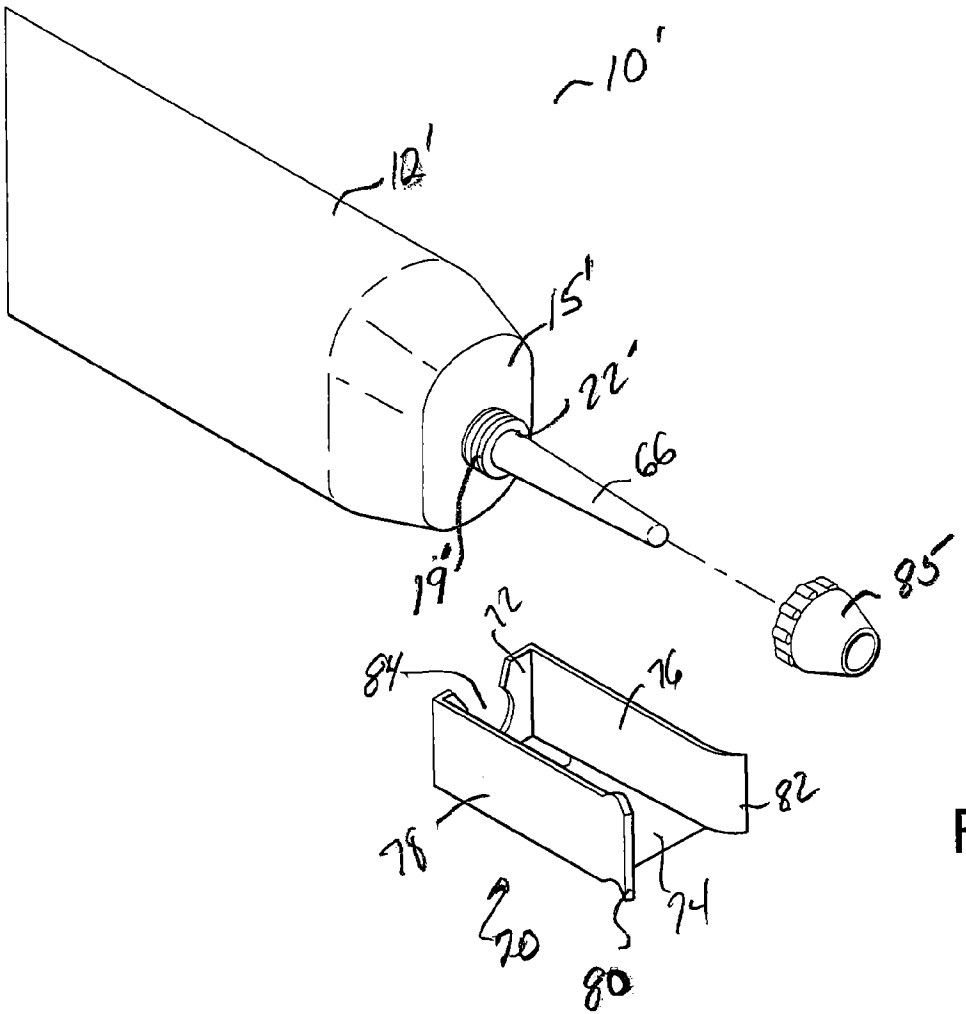
FIGS. 5 and 6 show the front end of an alternative embodiment of a dispensing gun of the present invention, respectively, in an exploded and assembled condition.
Figure 6:
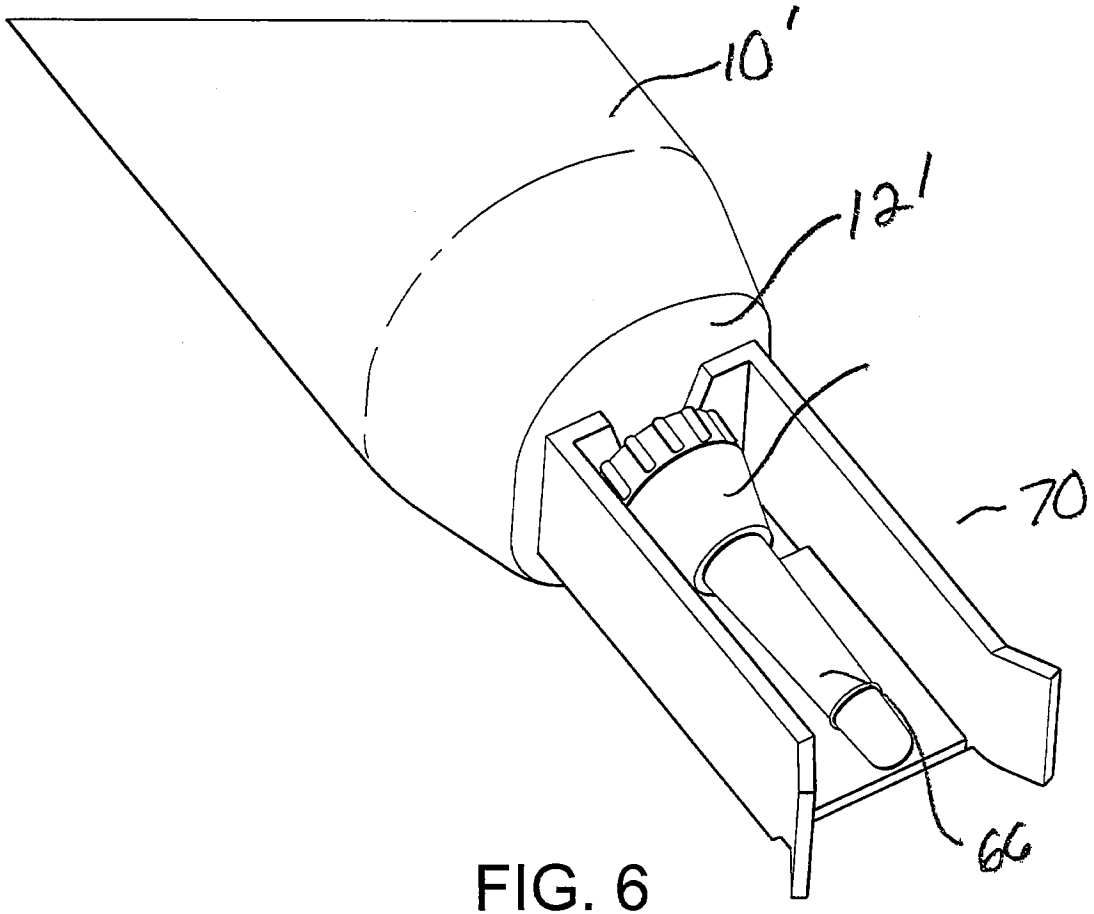

Referring now to FIGS. 5 and 6, a further embodiment of the present invention is shown. FIGS. 5 and 6 shows the front end of barrel 12' where the cap portion of the barrel is integrally formed. Thus, the front end 14' of barrel 12' terminates in a closed front end 15'. The closed front end 15' has a central aperture 22' therethrough which is surrounded by an extended externally threaded collar 19'. The nozzle 66 of tube 60 extends through the opening 22' and the threaded collar 19'.

The present invention further provides an alignment guide 70 which may be attached to the closed front end 15' of barrel 10'. While the alignment guide is shown in use with the embodiments of FIGS. 5 and 6, it may be appreciated that the alignment guide may be used with the embodiments of FIGS. 1-4.

Alignment guide 70 includes a back wall 72, a bottom wall 74 and a pair spaced apart guide walls 76 and 78. The guide walls have outwardly directed distal feet 80 and 82. The back wall 72 includes a generally U-shaped passageway 84 which is engageable about the extending threaded collar 16'. A threaded nut 85 is used to secure the alignment member 70 to the front end 15' of barrel 12'. As shown in FIG. 6, the alignment guide 70 when attached to the front end 15' of barrel 12' extends approximately the length of the extending nozzle 66. The outwardly directed feet 80 and 82 serve as positioners so that when the installer is applying adhesive to a surface such as a floor joist, the feet stabilize the nozzle during movement along the joist. This allows the installer to accurately place the proper amount of adhesive at the proper location on the joist. This results in accurate application and less waste.

While the invention has been described in relationship to the preferred embodiments, it will be understood by those skilled in the art that various changes may be made without deviating from the fundamental nature and scope of the invention as defined in the appended claims.

What is claimed is:

1. A gun for dispensing a flowable adhesive contained in a collapsible container which is dispensed through an extending dispensing nozzle, said gun comprising:

an elongate hollow barrel for accommodating said container, said barrel having a closed first end and an open second end;

said closed first end having an aperture therethrough for passage of said extending dispensing nozzle;

a handle attachable to said open second end of said barrel for closing said open second end, said handle having a connection port in communication with said hollow barrel for attachment to a source of pneumatic pressure, said handle is pivotally connected to said open second end of said barrel for pivotal movement between an open condition allowing access to said barrel to a closed position;

said handle further including a trigger operably connected to said connection port to allow controlled flow of air pressure into said barrel to collapse said container causing dispensing of said flowable adhesive through said nozzle.

2. A gun of claim 1 wherein said handle is generally in the shape of a pistol grip including a cap portion for engagement with said open end of said barrel and a grip portion.

3. A gun of claim 2 further including a sealing member interposed between said cap portion and said grip portion.

4. A gun of claim 3 wherein said sealing member includes a sealing ring supported on said handle.

5. A gun of claim 3 wherein said sealing member is an elastomeric O-ring supported by said cap portion of said handle.

6. A gun of claim 1 wherein said handle establishes fluid communication between said connection port and said hollow barrel.

7. A gun of claim 6 wherein said trigger is operable to selectively open and close said flow communication between said connection port and said hollow barrel.

8. A gun of claim 1 further including a latch for releasably maintaining said handle in said closed position.

9. A gun of claim 1 further including an alignment guide for attachment to said extending nozzle.

10. In combination:

a flexible collapsible tubular adhesive containing bag having a dispensing nozzle extending therefrom; and The gun of claim 1.

11. The combination of claim 10 wherein said collapsible bag is in the shape of an elongate tube having said dispensing nozzle extending from one end thereof.

12. A combination of claim 10 further including a cover for sealably covering said first end of said barrel, said cover having an aperture therealong for passage of said nozzle.

13. A gun for dispensing a flowable adhesive contained in a collapsible container which is dispensed through an extending dispensing nozzle, said gun comprising:

an elongate hollow barrel for accommodating said container, said barrel having a closed first end and an open second end;

said closed first end having an aperture therethrough for passage of said extending dispensing nozzle;

a handle attachable to said open second end of said barrel for closing said open second end, said handle having a connection port in communication with said hollow barrel for attachment to a source of pneumatic pressure;

said handle further including a trigger operably connected to said connection port to allow controlled flow of air pressure into said barrel to collapse said container causing dispensing of said flowable adhesive through said nozzle;

wherein said closed first end of said barrel is closed by a cover sealably attached to said first end.

14. In combination: a flexible collapsible tubular adhesive containing bag having a dispensing nozzle extending therefrom; and The gun of claim 13.

15. A gun for dispensing a flowable adhesive contained in a collapsible container which is dispensed through an extending dispensing nozzle, said gun comprising:

an elongate hollow barrel for accommodating said container, said barrel having a closed first end and an open second end;

said closed first end having an aperture therethrough for passage of said extending dispensing nozzle;

a handle attachable to said open second end of said barrel for closing said open second end, said handle having a connection port in communication with said hollow barrel for attachment to a source of pneumatic pressure;

said handle further including a trigger operably connected to said connection port to allow controlled flow of air pressure into said barrel to collapse said container causing dispensing of said flowable adhesive through said nozzle; and an alignment guide, wherein said alignment guide is an elongate member extending substantially the length of said extending nozzle having a first end attachable to said nozzle adjacent said first end of said barrel, and a second end having transversely spaced extending feet for containing with a surface onto which said adhesive is directed to stabilize said gun movement during dispensing.

16. In combination: a flexible collapsible tubular adhesive containing bag having a dispensing nozzle extending therefrom; and The gun of claim 15.

* * * * *